US005736809A

United States Patent [19]

Matsutani et al.

[11] Patent Number: 5,736,809

[45] Date of Patent: Apr. 7, 1998

[54] METHOD OF MAKING A SPARK PLUG INCLUDING LASER WELDING A NOBLE METAL LAYER TO A FIRING END OF ELECTRODE

[75] Inventors: Wataru Matsutani; Kozo Amano, both of Nagoya, Japan

[73] Assignee: NGK Spark Plug Co., Ltd., Nagoya, Japan

[21] Appl. No.: 676,840

[22] Filed: Jul. 8, 1996

Related U.S. Application Data

[62] Division of Ser. No. 401,685, Mar. 10, 1995, abandoned.

[30] Foreign Application Priority Data

Mar. 10, 1994 [JP] Japan ..... 6-040187

[51] Int. Cl.[6] ..... H01T 21/02

[52] U.S. Cl. ..... 313/141; 313/144; 445/9

[58] Field of Search ..... 313/141, 144; 445/7

[56] References Cited

U.S. PATENT DOCUMENTS

| | | | |
|---|---|---|---|
| 4,743,793 | 5/1988 | Toya et al. | 313/144 |
| 5,440,198 | 8/1995 | Oshima et al. | 313/141 |

FOREIGN PATENT DOCUMENTS

| | | | |
|---|---|---|---|
| A20545562 | 6/1993 | European Pat. Off. | H01T 21/02 |
| 5082236 | 2/1993 | Japan . | |
| A20549368 | 6/1993 | Japan | H01T 13/39 |
| 645049 | 2/1994 | Japan | H01T 21/02 |

*Primary Examiner*—Sandra L. O'Shea
*Assistant Examiner*—Joseph Williams
*Attorney, Agent, or Firm*—Sughrue, Mion, Zinn, Macpeak & Seas, PLLC

[57] ABSTRACT

In a spark plug having a noble metal layer disposed on a firing end of an electrode, the noble metal layer being laser welded to the firing end of the electrode, and subsequently heat treated to increase a crystallized granulation particle size of the noble metal layer.

2 Claims, 5 Drawing Sheets

METHOD OF MAKING A SPARK PLUG INCLUDING LASER WELDING A NOBLE METAL LAYER TO A FIRING END OF ELECTRODE

This is a Divisional of application Ser. No. 08/401,685 filed Mar. 10, 1995, now abandoned.

BACKGROUND OF THE INVENTION

1. Field of the Invention

This invention relates to a spark plug in which a noble metal layer is laser welded to a firing end of a center or outer electrode in order to increase its spark erosion durability.

2. Description of Prior Art

In a spark plug used hitherto, there is provided a center or outer electrode which has a heat-resistant metal (nickel or the like) as a base metal. To an outer surface of the electrode, a noble metal is welded in order to decrease its spark erosion. Upon welding the noble metal to the electrode, when laser beam welding is employed instead of an electrical resistance welding which has usually been used, the noble metal layer is thermally bonded to the electrode strongly enough to cause the disappearance of a boundary therebetween so as to significantly increase its spark erosion durability.

Upon thermally bonding the noble metal layer to the electrode by means of laser beam welding, the welding causes a local increase in the temperature of the portions to which the laser beams are applied concentrically so as to instantly melt the noble metal and the outer surface of the electrode with the other portion of the electrode left cold. This makes it possible to rapidly cool the molten noble metal so as to solidify it for a short period of time by the heat-drawing action of the electrode. This rapid cooling effect induces a dendriform crystallization in which the noble metal and the outer surface of the electrode are commonly melted. Due to the crystallized grains of the dendriform crystallization being minute, and the grain boundary being relatively fragile, it is feared that small clefts occur on the noble metal layer so as to develop them into cracks when in use with the spark plug mounted on an internal combustion engine.

With the long use of the internal combustion engine, it is conceivable the oxygen gas or combustion gas permeates into the clefts or the cracks so as to induce oxidation-corrosion at the boundary between the noble metal and the outer surface of the electrode. When the situation is aggravated, the oxidation-corrosion may exfoliate the noble metal layer from the outer surface of the electrode so as to deteriorate the spark erosion durability.

Therefore, it is an object of the invention to provide a spark plug which is capable of protecting the noble metal layer against the occurrences of clefts and cracks into which the corrosive substances are to permeate, in order to effectively prevent the noble metal layer from falling off the electrode so as to improve the spark erosion durability by heat-treating the noble metal layer after laser welding the noble metal layer to an outer surface of the electrode.

SUMMARY OF THE INVENTION

According to the invention, there is provided a spark plug comprising a noble metal layer which is welded to a firing end of an electrode. In particular, the noble metal layer is laser welded on the firing end of the electrode, and heat treated to increase a crystallized grannulation degree or particle size of the noble metal layer.

With the noble metal layer laser welded to the electrode, the noble metal layer is cooled for a shorter period of time, which causes to develop a minute dendriform structure in the noble metal layer which is subjected to a multitude of the clefts and cracks. By heat-treating (annealing) the noble metal layer, it is possible to recrystallize the dendriform structure so as to eliminate the clefts and cracks together with the intergranular space. With the elimination of the clefts and cracks, it is possible to protect the noble metal layer against the occurrences of clefts and cracks into which the corrosive matters are to permeate, in order to effectively prevent the noble metal layer from falling off the electrode so as to insure an extended use of the spark plug. It is preferable that an average grain size of the recrystallized dendriform structure is 10 microns or more when the annealing treatment is finished.

Upon thermally bonding the noble metal layer to the electrode, use of a pulse-type laser beam welding enhances an efficiency of the welding operation, while use of continuous-type laser beam welding makes the electrode red-hot to melt the electrode more into the noble metal layer so as to deteriorate its spark erosion resistance.

These and other objects and advantages of the invention will be apparent upon reference to the following specification, attendant claims and drawings.

DETAILED DESCRIPTION OF THE EMBODIMENT OF THE INVENTION

Figure 1:
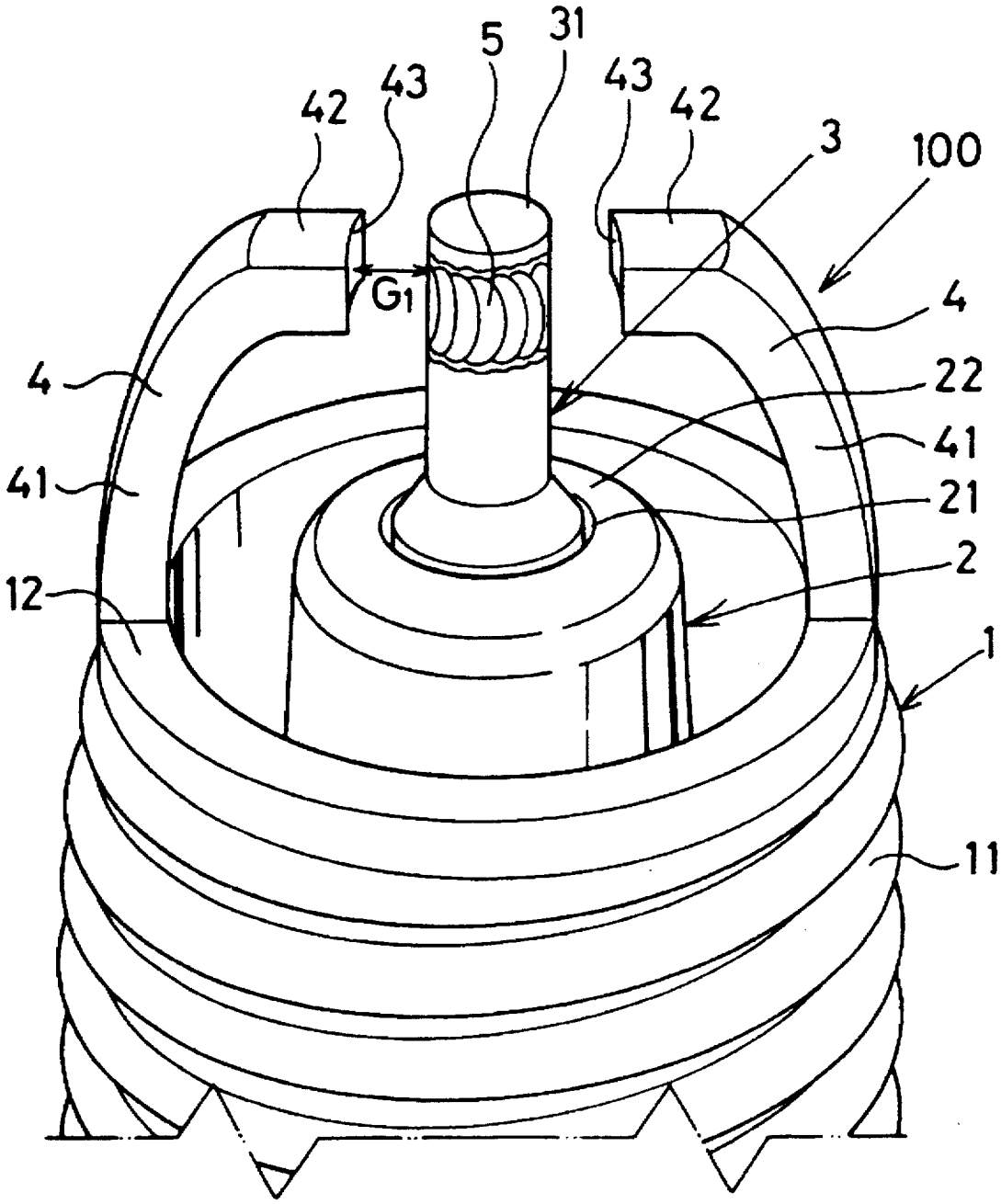
FIG. 1 is an enlarged perspective view of a front portion of a spark plug according to an embodiment of the invention.

Referring to FIG. 1 which shows a front portion of a dual-polarity type spark plug 100, the spark plug 100 has a cylindrical metallic shell 1 and an elongated insulator 2 placed within the metallic shell 1. The insulator 2 has an axial bore 21 circular in cross section whose front end 22 has a tapered portion. Within the axial bore 21 of the insulator 2, a columnar center electrode 3 is placed with its front end 31 slightly extended beyond the front end 22 of the insulator 2.

On an outer surface of the metallic shell 1, is a male thread 11 provided to mount the spark plug 100 on an internal combustion engine. To an annular front end 12 of the metallic shell 1, outer electrodes 4, 4 are thermally bonded in a manner to diametrically oppose each other. Each of the outer electrodes 4, 4 is rectangular in cross section whose one end is welded to the annular front end 12 of the metallic shell 1. From the one end of each of the outer electrodes 4, 4, is a support portion 41 extended to somewhat tilt toward a central portion of the center electrode 3. A front end of the support portion 41 is turned to form a firing portion 42 which opposes the front end 31 of the center electrode 3. A front end surface 43 of the firing portion 42 of the outer electrode 4 is tubularly provided to be concentrical with the front end 31 of the center electrode 3 so as to form a spark gap G1 between the front end surface 43 and an outer surface of the front end 31 of the center electrode 3.

To an outer surface of the front end 31 of the center electrode 3 which is diametrically thinned, is a platinum-based noble metal layer 5 laser welded.

The noble metal layer 5 is provided as follows:

Firstly, a noble metal wire 50 is prepared which is made of platinum, iridium, platinum-iridium alloy or platinum-nickel alloy. The noble metal wire 50 is wound around a groove 32 provided with the front end 31 of an electrode metal 30 of the center electrode 3 as shown in FIG. 2*a*. Then, laser beams (R) are shot four times to the noble metal wire 50 at 12 pulses/milliseconds a pulse width at 2 milliseconds while continuously revolving the electrode metal 30 at a predetermined pitch. This operation makes it possible to melt an entire portion of the noble metal wire 50 and the groove 32 of the electrode metal 30 so as to solidify the noble metal layer 5 on the front end 31 of the electrode metal 30. Upon shooting the laser beams (R), the noble metal wire 50 and front end of the electrode metal 30 are instantaneously molten to integrally form an alloy in order to laser weld the noble metal layer 5 to the front end of the center electrode 3 as shown in FIG. 2*b*. In this instance, the laser beams (R) and the revolution of the electrode metal 30 may be applied intermittently or continuously.

After the completion of the laser welding, the noble metal wire 50 and the front end of the electrode metal 30 are rapidly deprived of heat to drop their temperature below the solidified point due to the heat-drawing action by the other portion of the electrode metal 30 which is left cold.

According to the laser welding, the alloy of the noble metal layer 5 and the electrode metal 30 penetrates deep into the electrode metal 30 to be strongly bonded to the electrode metal 30. This makes it possible to favorably protect the noble metal layer 5 from accidentally falling off the electrode metal 30, as against the case in which the noble metal layer is provided by means of electrical resistance welding, cold forging or inert gas shield welding.

Upon applying the laser welding, the temperature rise is observed in which the laser beams are locally shot to the portions, of the electrode metal 30 and the noble metal wire 50, in order to be instantaneously molten together to form the alloy, and rapidly cooled to be solidified by the heat-drawing action of the other portion of the electrode metal 30 which is left cold. This rapid cooling makes it possible to swiftly finish the welding operation so as to improve the productivity, while on the other hand, rendering the noble metal layer 5 into a dendriform structure in which crystallization appears 1 micron in diameter and 10 microns in length as shown in FIGS. 3*a*–3*d*. In the dendriform structure, its orientation is not certain in which the treeing grows partly in vertical direction, and develops partly in lateral direction.

Figure 3A:
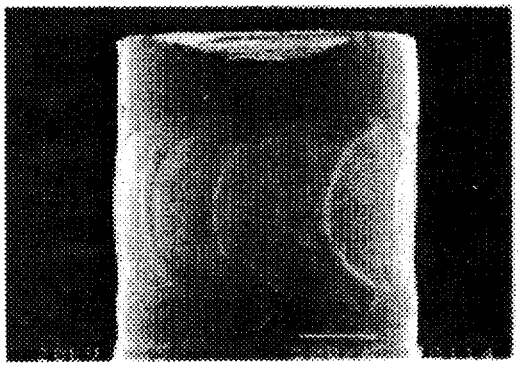
Fig. 3a PRIOR ART
FIGS. 3*a*–3*d* are microscopic views of a metallic structure of a prior noble metal layer thermally bonded to a center electrode.
Figure 3B:
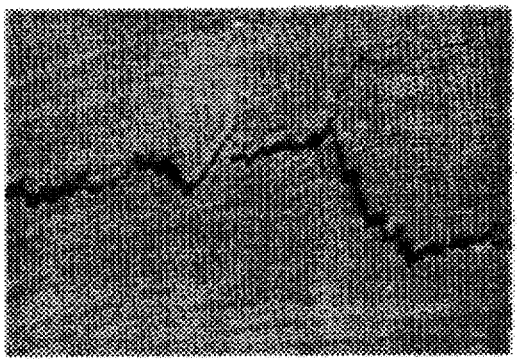
Fig. 3b PRIOR ART
Figure 3C:
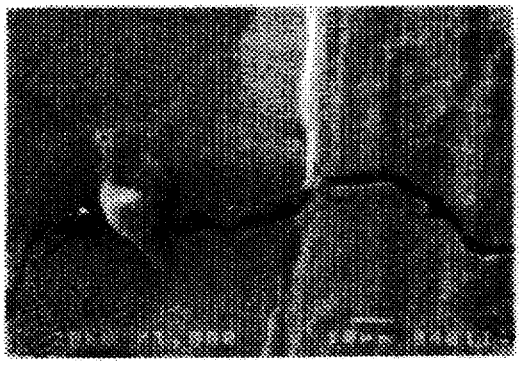
Fig. 3c PRIOR ART
Figure 3D:
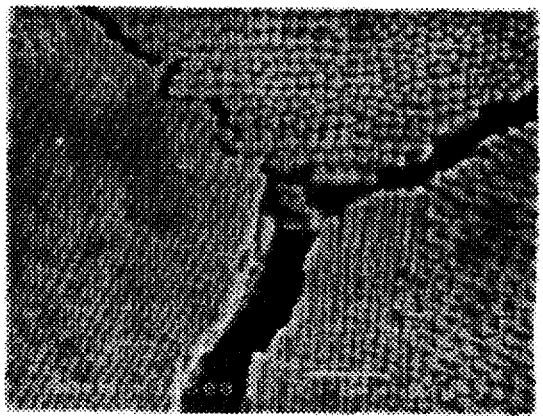
Fig. 3d PRIOR ART

At the boundary between a series of the laterally extended trees and a series of the vertically grown trees, minute clefts and cracks 51 tend to appear at the central portion upon laser welding the noble metal layer 5 and in use of the spark plug 100 as shown in FIG. 3*a* in which a photograph of the front end 31 of the center electrode 3 is magnified 35 times. This holds true at the boundary within the laterally extended tree and the vertically grown tree, FIG. 3*b* shows a photograph of the noble metal layer 5 which is magnified 1000 times, FIG. 3*c* shows a magnified photograph of the outer surface of the noble metal layer 5. FIG. 3*d* shows a photograph of the central portion of FIG. 3*b* magnified 3500 times to suggest that the cracks 51 have permeated deeply.

Figure 2C:
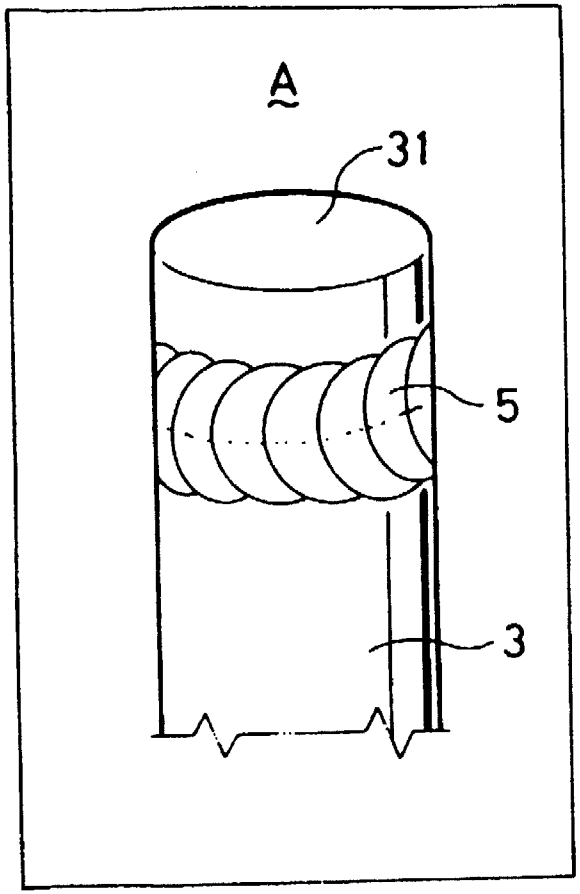
FIGS. 2*a*–2*c* are sequential views showing how a noble metal layer is laser welded to a fringe end of a center electrode according to the embodiment of the invention.
Figure 2B:
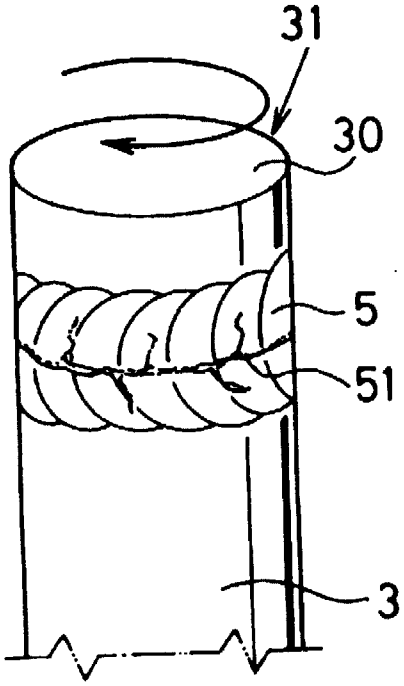
Figure 2A:
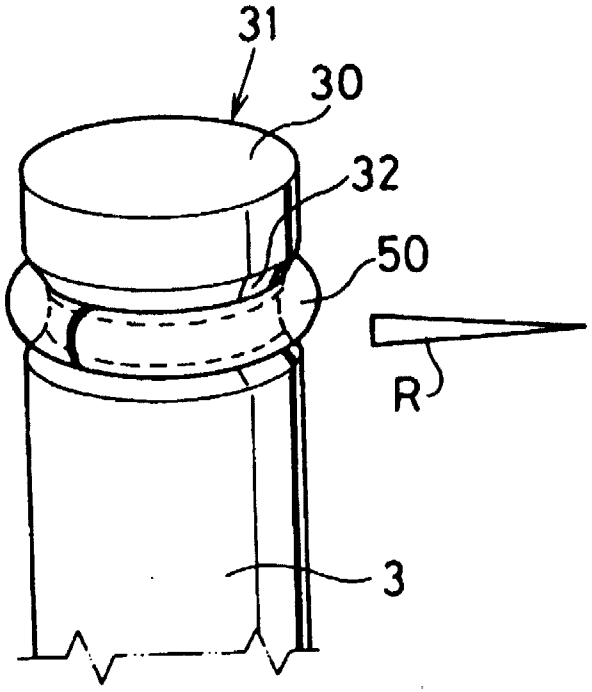
Figure 4A:
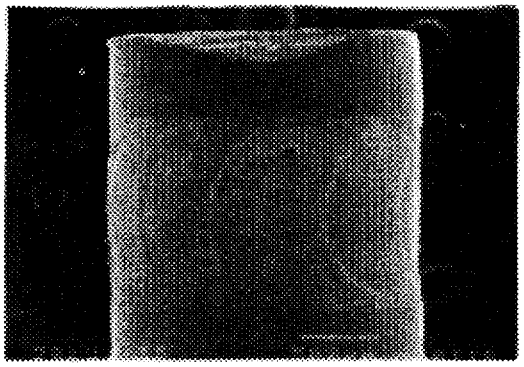
FIGS. 4*a*–4*c* are microscopic views of a metallic structure of the noble metal layer thermally bonded to the center electrode according to the embodiment of the invention.
Figure 4C:
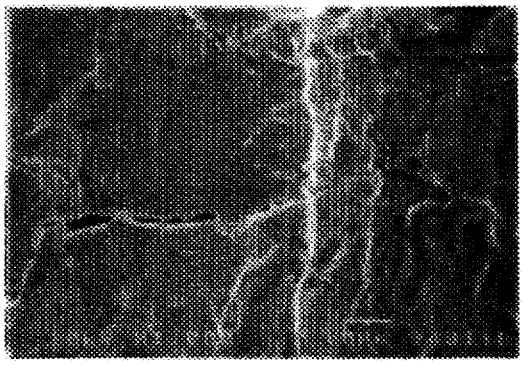
Figure 4B:
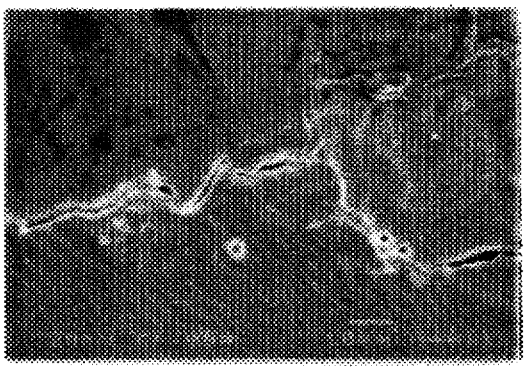

Reverting back to FIG. 2*c*, the center electrode 3 is placed in a vacuum kiln (A) to anneal the electrode 3 at 800°–1000° C. for 1–10 hours under $10^{-2}$–$10^{-8}$ Torr. This tempering treatment makes the dendriform structure as shown in FIGS. 4*a*–4*c* which in turn correspond to FIGS. 3*a*–3*c*. It is apparent from FIGS. 4*a*–4*c* that the annealing procedure develops large recrystallized grains to substantially eliminate the minute clefts and greater cracks 51, and thus the boundary disappears between the noble metal layer 5 and the electrode metal 30 of the center electrode 3. In this instance, it is possible to select the annealing time period, temperature and the ambient atmosphere as desired depending upon the material of the electrode metal 30 and the thickness of the noble metal layer 5.

A dual polarity type spark plug is prepared in which a noble metal (Pt) layer is pulse-laser welded to the electrode metals and at the same time, preparing the spark plug 100 in which the noble metal (Pt) layer 5 is annealed. Upon carrying out a durability test, these two types of spark plugs are respectively mounted on a six-cylinder gasoline engine. After operating the engine for 50000 Km, it is found in the former spark plug that the oxidation-corrosion occurs 10% at the boundary between the noble metal layer and the electrode metal. On the contrary, substantially no oxidation-corrosion is found in the latter spark plug 100 after investigating the experimental test results.

Figure 5A:
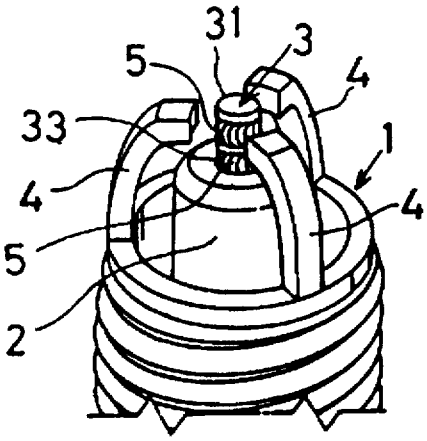
FIGS. 5*a*–5*f* are perspective views of the front portion of the spark plug according to other embodiments of the invention.

FIGS. 5*a*–5*f* show the noble metal layer according to other embodiments of the invention. The same noble metal layer 5 may be laser welded to a portion 33 penetrated into the front open end of the insulator 2, in addition to the noble metal layer 5 already welded to the front end of the electrode metal 30 as shown in FIG. 5*a* since the noble metal layer is effectively employed to a multi-polarity type spark plug in which more than two of the outer electrodes are provided.

Figure 5B:
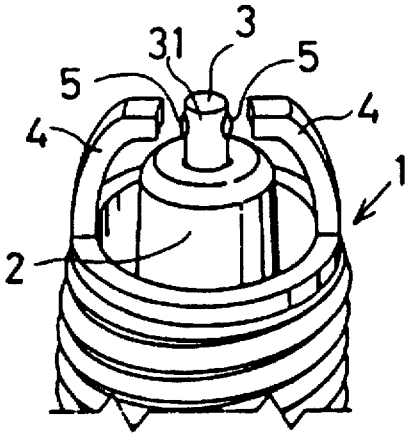

The noble metal layer 5 need not be provided all through the circumferential length of the front end 31 of the electrode metal 30, but the layer is partly welded to its circumferential length as shown in FIG. 5*b*.

Figure 5C:
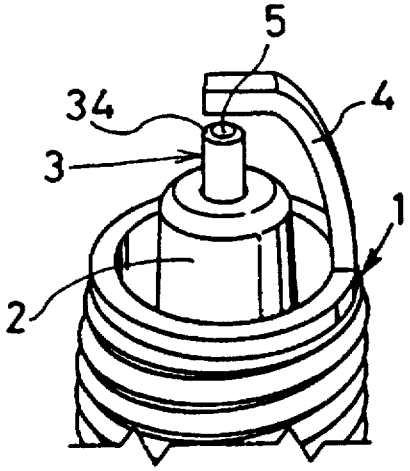

The noble metal layer 5 may be laser welded to a front end surface 34 of the center electrode 3 as shown in FIG. 5*c*.

Figure 5D:
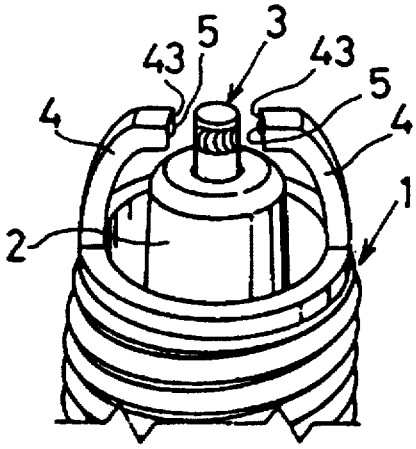

As shown in FIG. 5*d*, the noble metal layer 5 may be laser welded to the front end surface 43 of the outer electrodes 4.

Figure 5E:
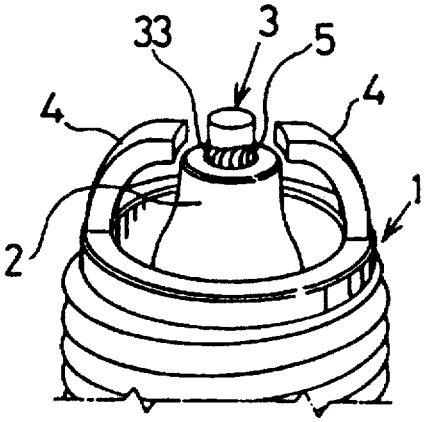

FIG. 5*e* shows a semi-creeping type spark plug in which the noble metal layer is laser welded to the portion 33 penetrated into the front open end of the insulator 2.

Figure 5F:
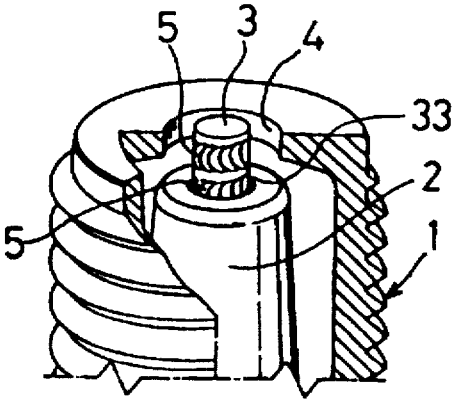

FIG. 5*f* shows another semi-creeping type spark plug in which the outer electrode 4 is integrally formed into an annular configuration with the front end of the metallic shell 1, and the same noble metal layer 5 may be laser welded to the portion 33 penetrated into the front open end of the insulator 2, in addition to the noble metal layer 5 already welded to the front end of the electrode metal 30.

It should be understood that other types of spark plugs than the above ones may be employed when the noble metal layer 5 is laser welded to the electrode.

It is noted that a $CO_2$ laser or eximer (excited dimer) laser may be used in addition to YAG laser.

It is also appreciated that the noble metal layer may be annealed in an inert gas atmosphere, nitrogen atmosphere, hydrogen atmosphere or the like upon carrying out the heat treatment.

While the invention has been described with reference to the specific embodiments, it is understood that this description is not to be construed in a limiting sense inasmuch as various modifications and additions to the specific embodiments may be made by skilled artisans without departing from the spirit and scope of the invention.

What is claimed is:

1. A method of making a spark plug which includes a noble metal layer welded to a firing end of an electrode, said method comprising the steps of:

(a) laser welding the noble metal layer on the firing end of the electrode; and (b) subsequently annealing the noble metal layer at 800°–1000° C. for 1–10 hours under $10^{-2}$–$10^{-8}$ Torr so as to increase a recrystallized grain size of the noble metal layer to 10 microns or more on average diameter.

2. The method as recited in claim 1, wherein the noble metal layer is selected from the group consisting of platinum, iridium, platinum-iridium alloy and platinum-nickel alloy.

* * * * *